United States Patent [19]

Artaud et al.

[11] Patent Number: 4,589,375

[45] Date of Patent: May 20, 1986

[54] STEAM GENERATOR FOR A LIQUID METAL-COOLED REACTOR

[75] Inventors: Robert Artaud, Aix en Provence; Michel Aubert, Manosque; Charley Renaux, Jouques, all of France

[73] Assignee: Commissariat a l'Energie Atomique, Paris, France

[21] Appl. No.: 597,656

[22] Filed: Apr. 6, 1984

[30] Foreign Application Priority Data

Apr. 7, 1983 [FR] France ..... 83 05693

[51] Int. Cl.[4] ..... F22B 37/42

[52] U.S. Cl. ..... 122/504; 122/32; 165/134.1; 376/277; 376/283

[58] Field of Search ..... 122/504, 506, 32, 504.1; 165/134; 376/277, 283

[56] References Cited

U.S. PATENT DOCUMENTS

| | | | |
|---|---|---|---|
| 3,438,431 | 4/1969 | Dreyer et al. | 165/134 R |
| 3,583,479 | 6/1971 | Taylor et al. | 165/134 R |
| 4,293,385 | 10/1981 | Brachet | 376/283 |
| 4,469,051 | 9/1984 | Malaval | 122/504 X |

FOREIGN PATENT DOCUMENTS

| | | |
|---|---|---|
| 1131702 | 12/1962 | Fed. Rep. of Germany . |
| 1518393 | 2/1968 | France . |
| 2013194 | 3/1970 | France . |
| 2394051 | 1/1979 | France . |

*Primary Examiner*—Edward G. Favors

[57] ABSTRACT

A steam generator for transferring the heat carried by a liquid metal to a water - steam circuit. It comprises a drainage tank directly suspended at the lower end of the envelope. A drainage tube connected to the bottom of the envelope is disposed within the tank and carries a burster disk at its end. This disk is placed behind a detachable observation window, fixed to the drainage tank and permitting the replacement thereof.

10 Claims, 2 Drawing Figures

STEAM GENERATOR FOR A LIQUID METAL-COOLED REACTOR

BACKGROUND OF THE INVENTION

The present invention relates to a steam generator or boiler for ensuring the heat exchange between the secondary circuit and the tertiary circuit of a liquid metal-cooled nuclear reactor.

It is known that fast neutron nuclear reactors comprise at least two successive cooling circuits making it possible to pass the maximum amount of heat given off by the fuel elements in the reactor core to turbogenerators, which convert the said heat into electric power. More specifically, the liquid metal, generally constituted by sodium, circulating in the primary circuit transfers the heat given off in the core to heat exchangers, in which part of this heat is transferred to liquid metal, which is also usually formed by sodium, circulating in the secondary circuit. This secondary circuit in turn makes it possible to pass this heat to steam generators, in which it is used for evaporating the water circulating in the tertiary circuit. The thus formed steam drives the turboalternators, which are also located in the tertiary circuit.

The steam generators for ensuring the heat exchange between the primary fluid and the secondary fluid generally comprise a vertically axed cylindrical envelope, in which the sodium of the secondary circuit circulates between the inlet and outlet tubes. Thus, the sodium is in contact with the tubes of a bundle of tubes arranged within the envelope and in which the water of the tertiary circuit circulates.

Such a steam generator is diagrammatically shown in exemplified manner in FIG. 1, in which it is possible to see the cylindrical envelope 10, the inlet tubes 12 for the secondary sodium and preferably located in the vicinity of the upper end of envelope 10 and the outlet tube 14 for the secondary sodium, which in this case issues into the bottom of the generator envelope. Thus, the secondary sodium circulates from top to bottom within envelope 10, which forms the most favourable flow direction, because the formation of steam in the tube 16 of the tube bundle shown in FIG. 1 virtually imposes a bottom to top circulation of the water within these tubes. Tubes 16 pass through the envelope 10 of the steam generator and issue, on the one hand into one or more upstream collectors 18 arranged in the vicinity of the bottom of envelope 10, and on the other hand into one or more downstream collectors 20, positioned slightly below the secondary sodium inlet tubes 12. Within envelope 10, tubes 16 are helically wound around the central core 22, in such a way that they occupy the annular space defined between said core and envelope 10. As is also illustrated in FIG. 1, core 22 is extended up to the secondary sodium outlet tube 14, so that passages 24 must be formed in the lower part of core 22 to permit the flow of secondary sodium from the annular space formed between the said core and envelope 10 up to the outlet tube 14.

It is readily apparent that in a fast neutron nuclear reactor, the steam generators constitute particularly sensitive components, because there is a circulation therein of both liquid sodium and water and the large number of tubes in the bundle necessary for the effectiveness of the heat exchange correspondingly increases the risks of a sodium - water reaction within the generator envelope.

To take account of this risk, it is conventional practice to associate with the steam generator an installation making it possible to rapidly drain the same, when an overpressure due to a sodium - water reaction occurs in the generator. At present, and as is very diagrammatically illustrated in FIG. 1, such an installation comprises an auxiliary drainage tank or reservoir 26 resting on the ground surface 28 and a large diameter pipe 30 connecting the bottom of the steam generator envelope to tank 26. Pipe 30 is normally sealed by at least one burster disk 32, which is sensitive to the pressure prevailing in the generator, so that it bursts when this pressure exceeds a predetermined threshold corresponding to the appearance of a sodium - water reaction in the generator. More specifically, it can be seen in FIG. 1 that the burster disk 32 is located in pipe 30 in the vicinity of the bottom of envelope 10. In existing installations, the drainage tank has a large capacity and is used for storing all the sodium contained in the secondary circuit. This construction of existing installations is relatively unsatisfactory for a number of reasons.

Firstly, differential expansions can occur in pipe 30. Thus, bearing in mind the large cross-section of these pipes indispensable for the rapid draining of the steam generator in the case of a sodium - water reaction, it is relatively uneconomic to compensate these expansions by providing the pipes with expansion bends. Thus, these bends increase the length of the tubes and consequently the costs of the installation. Therefore, and as is illustrated in FIG. 1, the pipes 30 are advantageously equipped with expansion bellows 34. However, it is known that after a certain period of use, the mechanical stability and strength of these bellows tends to decrease. Thus, the presence of such bellows has the effect of introducing a supplementary risk from the safety standpoint.

Moreover, when the burster disk has burst as a result of a sodium - water reaction in the steam generator, it must be replaced before putting the reactor back into operation. This disk is also replaced during periodic maintenance inspections. This operation is difficult in existing installations, as a result of the positioning of the disk in the pipe.

Moreover, although the pipe diameter permits a relatively large sodium flow, the length of said pipe is generally such that the time necessary for the complete emptying of the generator is not as short as would be desired under overpressure conditions produced by a sodium - water reaction.

SUMMARY OF THE INVENTION

The problem of the present invention is to provide a steam generator having an integrated drainage tank fulfilling the same function as tank 26 of the prior art installations, such as shown in FIG. 1, whilst having a particularly simple design and whilst eliminating the disadvantages referred to hereinbefore in connection with existing installations.

The present invention therefore relates to a steam generator for a liquid metal-cooled reactor, said generator comprises a vertically axed cylindrical envelope, inlet and outlet tubes for the liquid metal with respect to said envelope, a bundle of tubes located within the envelope and in which circulates water, and a drainage tube issuing at the lower end of said envelope and having at least one burster disk able to burst when the pressure prevailing in the envelope exceeds a given threshold, in order to link the envelope with a drainage tank, wherein the drainage tank is directly fixed to the lower end of the envelope, the drainage tube being located within the tank and carrying at its end the burster disk behind a detachable observation window fixed to the tank.

According to a preferred embodiment of the invention, the drainage tank comprises a cylindrical neck extending downwards a cylindrical part of the envelope and a larger cross-section container connected to the lower end of the cylindrical neck, the detachable observation window being fixed to the neck of the tank.

Preferably, the drainage tube is then terminated by a substantially horizontal part, whose end which carries the burster disk is located in an opening formed in the neck of the tank and to which is fixed the detachable observation window. The drainage tube can also have a substantially vertical part arranged along the axis of the envelope and connected by an elbow to the substantially horizontal part.

According to a first constructional variant of the invention, the detachable observation window closes the said opening, in such a way that the bursting of the burster disk has the effect of draining into the tank neck the liquid metal contained in the envelope.

According to a second constructional variant of the invention, the detachable observation window is in the form of a pipe fixed on the one hand to the opening formed in the tank neck, and on the other hand to a second opening formed in the container, in such a way that the bursting of the burster disk has the effect of draining the liquid metal in the envelope into the said container. The second opening can more particularly be formed in an upper wall of the container, the axes of said openings being disposed in the same plane passing through the envelope axis and substantially at right angles to one another, in such a way that the pipe formed by the observation window is shaped like an elbow.

According to a secondary feature of the invention, the volume of the drainage tank is substantially equal to the volume of the liquid metal contained in the envelope of the generator. Moreover, means can be provided for draining the drainage tank into a larger capacity reservoir.

BRIEF DESCRIPTION OF THE DRAWINGS

The invention is described in greater detail hereinafter relative to two non-limitative embodiments and the attached drawings, wherein show.

DETAILED DESCRIPTION OF THE PREFERRED EMBODIMENTS

Figure 1:
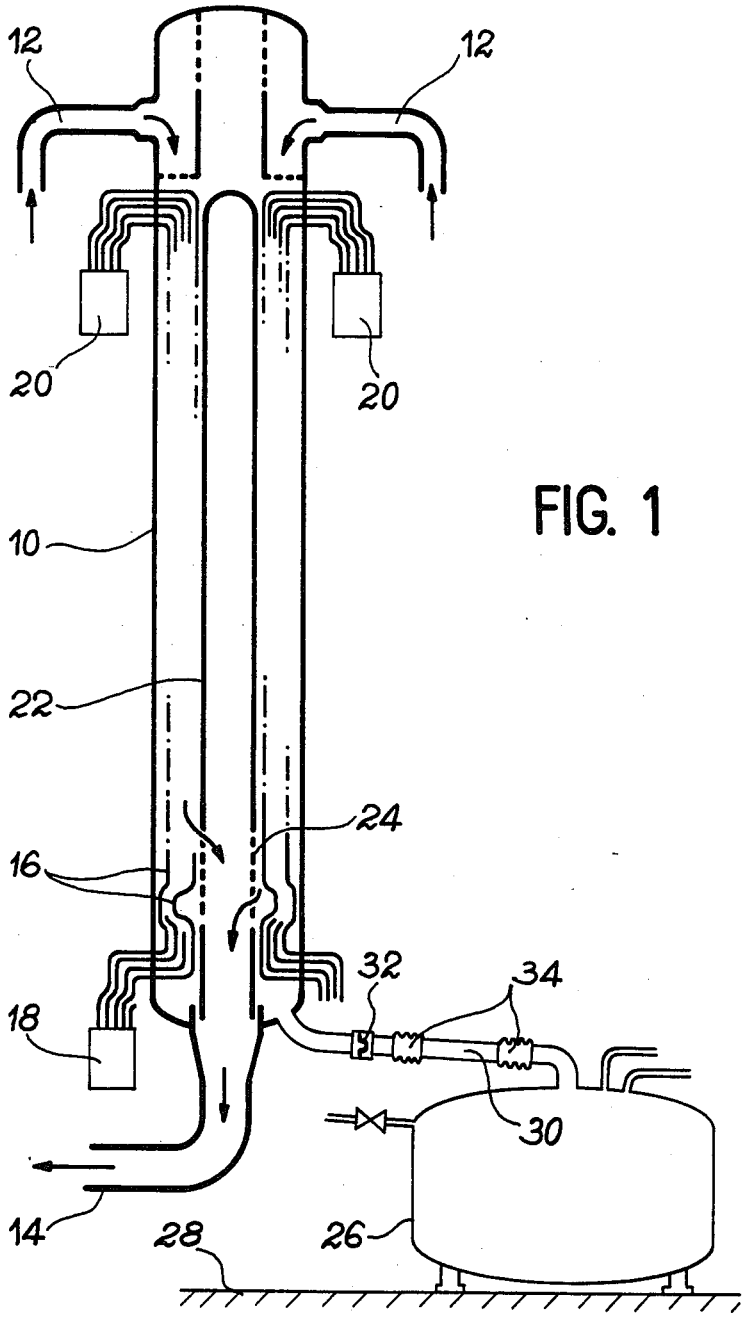
FIG. 1, already described, diagrammatically a steam generator equipped with a separate drainage installation in accordance with the prior art.
Figure 2:
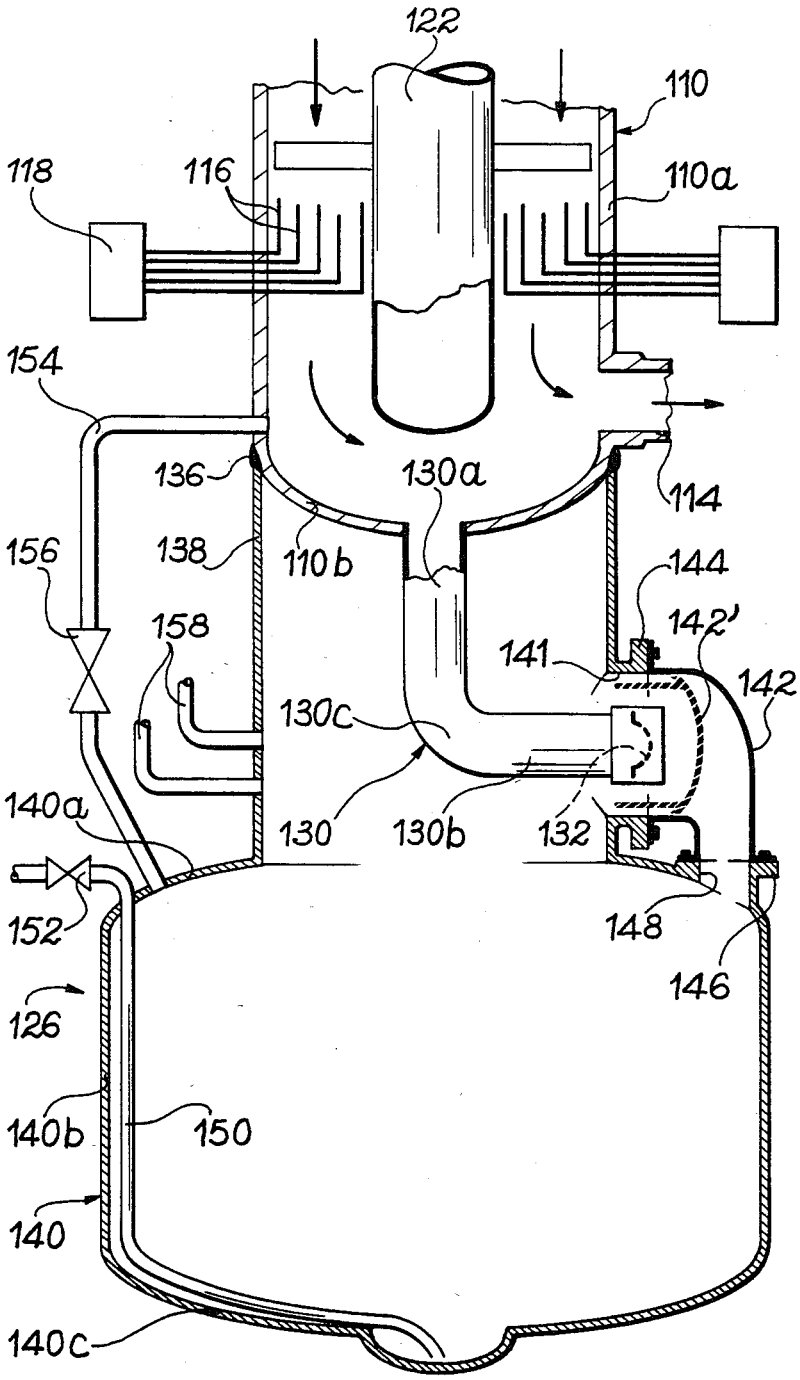
FIG. 2 diagrammatically and on a larger scale, the lower end of a steam generator having, in accordance with the invention, an integrated drainage tank.

FIG. 2 only shows the lower part of the steam generator according to the invention, because only this part differs from the presently known steam generators. In particular, the remainder of the steam generator according to the invention can be constructed in the same way as the corresponding part of that described with reference to FIG. 1 for illustrating the state of the art.

However, it is readily apparent that numerous types of known steam generators could be modified in accordance with the invention, in such a way that the latter does not have to be limited to the generator described hereinbefore with reference to FIG. 1. In particular, the secondary sodium inlet and outlet tubes and the circulation of said sodium within the generator envelope can be realised in other known ways without passing beyond the scope of the invention. This also applies with respect to the location occupied by the bundle of tubes in the generator and the shape given to the tubes of the bundles.

It is possible to see in FIG. 2, the vertically axed cylindrical envelope 110 of the steam generator. In per se known manner, this envelope has a dome (not shown), a cylindrical part 110*a* and a base 110*b*. It is also possible to see the upstream collectors 118 and the bundle of tubes 116, positioned within the steam generator in the annular space defined between the cylindrical part 110*a* of the envelope and the central core 122.

According to the invention, the drainage tank 126 is directly fixed to the lower end of the generator envelope 110. More specifically, tank 126 has a neck 138 in the form of a ferrule and a container 140 constituting the actual tank. Neck 138 is cylindrical, has the same diameter as envelope part 110*a* and its axis coincides with the vertical axis of the envelope. Its upper edge is fixed to envelope 110 by a weld 136, in such a way that it extends downwards the cylindrical part 110*a* and supports at its lower end container 140. As is illustrated in FIG. 2, the latter has a larger cross-section than neck 138. Thus, it defines an upper wall 140 by which it is connected to neck 138, a side wall 140*b*, which can be cylindrical or have any other shape, as well as a base 140*c*.

The connection between the interior of envelope 110 and tank 126 is brought about by means of a drainage tube 130, located in the tank neck 138. The upper end of tube 130 issues into the base 110*b* of the steam generator envelope, the lower end carrying a burster disk 132.

More specifically, FIG. 2 shows that tube 130 is connected to the generator envelope base 110*b* by a substantially vertical part 130*a*, arranged coaxially to said cylindrical part 110*a* and to the tank neck 138. The burster disk 132 is mounted on the end of a substantially horizontal part 130*b* of the drainage tube. Parts 130*a* and 130*b* are connected by an elbow 130*c*. The length of the substantially vertical part 130*a* is less than the height of neck 138 and the length of the substantially horizontal part 130*b* is close to the radius of neck 138, in such a way that disk 132 is located in an opening 141 formed in the lower part of the neck of tank 126.

According to a first constructional variant of the invention shown in unbroken line form in FIG. 2, a detachable observation window 142 in the form of a pipe is fixed on the one hand to a flange 144 surrounding opening 141, and on the other hand to a flange 146 surrounding an opening 148 formed in the upper wall 140*a* of container 140. This tight fixture is brought about by any known means, such as screws or bolts.

More specifically, the axes of openings 141 and 148 are respectively horizontal and vertical and are located in the same plane passing through the vertical axis common to envelope 110 and neck 138, the observation window 142 in the form of a pipe being shaped like an elbow, which extends the drainage tube 130.

The pipe formed by observation window 142 thus makes it possible, following the bursting of burster disk 132, to allow the liquid sodium contained in envelope 110 of the steam generator to flow directly into the container 140 of the drainage tank.

In the second constructional variant of the invention shown in broken line form in FIG. 2, the observation window 142', behind which is placed the burster disk 132, is constituted by a plug sealing opening 141. This plug can be fixed to flange 144 by screws or bolts, in the same way as observation window 142 in the preceding variant. In this case, the liquid sodium flowing from the steam generator following the bursting of disk 132 is forced back by plug 142' into the tank neck 138, before dropping into container 140. Obviously, to enable this circulation to take place, plug 142' is located at a certain distance from disk 132 and the diameter of opening 141 significantly exceeds the diameter of tube 130.

Bearing in mind the location of tube 130 in the place of the secondary sodium outlet tube in the steam generator of FIG. 1, there is a need to modify the positioning thereof. Thus, the outlet tube 114 can be positioned laterally at the lower end of cylindrical part 110*a* of the generator envelope, in the manner shown in FIG. 2. Core 122 is then closed at its lower end, which is at a certain distance from base 110*b*.

As has been stated hereinbefore, this arrangement is given in a non-limitative manner. Thus, tube 130 issuing into the base 110*b* of the envelope could be off-centered, in such a way as to permit the installation of outlet tube 114 in the bottom of the generator. Outlet tube 114 would then pass through the drainage tank neck 138. Conversely, the secondary sodium outlet tube 114 could be located at the upper end of the steam generator, the sodium then rising within a shaft replacing core 122.

According to a secondary feature of the invention, the volume of storage tank 126 is just sufficient to collect the secondary sodium contained in the steam generator following the bursting of burster disk 132. This distinguishes the invention from the prior art, according to which the drainage tank was constituted by the storage tank used for draining the complete secondary circuit of the reactor and whose volume is much larger than that of tank 126.

Preferably, the bottom of drainage tank 126 is linked with a not shown, larger storage reservoir, which is common to several steam generators. This link can be brought about by means of a pipe 150, equipped with a valve 152 and pumping means (not shown ). One end of pipe 150 issues into the bottom of tank 126, in the manner shown in FIG. 2. In view of the fact that there is no need for a rapid transfer of the liquid sodium between drainage tank 126 and the storage reservoir, pipe 150 has a small diameter, so that it is easily possible to compensate differential expansions by equipping it with expansion bends.

When tank 126 has been drained by pipe 150, it becomes possible to replace the disk 132 by removing observation window 142 or 142'. Thus, for obvious safety reasons, this intervention must be carried out without it being possible to directly see the sodium. FIG. 2 also shows that a pipe 154, equipped with a normally closed valve 156, makes it possible to link the interior of envelope 110 with tank 126. Pipe 154 makes it possible, when this is necessary and when disk 132 has not burst, to drain the sodium contained in the steam generator envelope into the drainage tank 126, following the opening of valve 156.

Finally, FIG. 2 shows pipes 158 issuing into drainage tank 126 and are used, when a sodium - water reaction occurs within the envelope, to remove gaseous products formed as a result of this reaction, such as hydrogen or sodium aerosols. These pipes are connected by their opposite end to not shown separators.

As a result of the characteristics of the invention described hereinbefore relative to FIG. 2, it is readily apparent that the problems caused by the prior art installations are completely solved. In particular, the safety is further increased, because the expansion bellows are eliminated. Moreover, it can be seen that the special arrangement of the burster disk 132 enables it to be particularly easily replaced. Moreover, tube 130 ensuring the flow of liquid sodium from the steam generator to the drainage tank is significantly shorter than the prior art connecting pipe, in such a way that the speed of drainage is significantly increased. Finally, the fitting of the tank to the steam generator is particularly simple and even permits the installation thereof on existing generators.

What is claimed is:

1. A steam generator for a liquid metal-cooled reactor, said generator comprises a vertically axed cylindrical envelope, inlet and outlet tubes for the liquid metal with respect to said envelope, a bundle of tubes located within the envelope and in which circulates water, and a drainage tube issuing at the lower end of said envelope and having at least one burster disk able to burst when the pressure prevailing inthe envelope exceeds a given threshold, in order to link the envelope with a drainage tank, wherein the drainage tank is directly fixed to the lower end of the envelope, the drainage tube being located within the tank and carrying at its end the burster disk behind a detachable observation window fixed to the tank.

2. A steam generator according to claim 1, wherein the drainage tank comprises a cylindrical neck extending downwards a cylindrical part of the envelope and a larger cross-section container connected to the lower end of the cylindrical neck, the detachable observation window being fixed to the neck of the tank.

3. A steam generator according to claim 2, wherein the drainage tube is terminated by a substantially horziontal part, whose end carrying the burster disk is located in an opening formed in the neck of the tank and to which is fixed the removable observation window.

4. A steam generator according to claim 3, wherein the drainage tube has a substantially vertical part arranged in the axis of the envelope and which is connected by an elbow to the substantially horizontal part.

5. A steam generator according to claim 3, wherein the detachable observation window seals the opening, in such a way that the bursting of the burster disk drains the liquid metal in the envelope into the neck of the tank.

6. A steam generator according to claim 3, wherein the detachable observation window is in the form of a pipe, fixed on the one hand to the opening formed in the tank neck, and on the other hand to a second opening formed in the container, in such a way that the effect of the bursting of the burster disk is to drain the liquid metal contained in the envelope into the container through said fixed pipe.

7. A steam generator according to claim 6, wherein the second opening is formed in an upper wall of the container, the axes of said openings being located in the same plane passing through the axis of the envelope and substantially at right angles to one another, in such a way that the pipe formed by the observation window is in the form of an elbow.

8. A steam generator according to claim 1, wherein the volume of the drainage tank is substantially equal to the volume of the liquid metal contained in the generator envelope.

9. A steam generator according to claim 1, wherein means are provided for draining the drainage tank into a larger capacity reservoir.

10. A steam generator according to claim 1, wherein a drainage pipe which is normally closed by at least one valve, directly links the drainage tank with the interior of the envelope.

* * * * *